United States Patent [19]

Wirtgen

[11] 4,037,981

[45] July 26, 1977

[54] MACHINE FOR CUTTING AWAY OR PEELING OFF ROAD SURFACES

[76] Inventor: Reinhard Wirtgen, Hohner Strasse, 5461 Windhagen, Linz, Germany

[21] Appl. No.: 647,914

[22] Filed: Jan. 9, 1976

[30] Foreign Application Priority Data

Jan. 10, 1975 Germany ..... 2500861

[51] Int. Cl.[2] ..... E01C 23/08

[52] U.S. Cl. ..... 404/91; 198/316; 214/83.34

[58] Field of Search ..... 404/91, 90; 198/125, 198/117; 299/34, 56; 214/83.34, 83.36

[56] References Cited

U.S. PATENT DOCUMENTS

| | | | |
|---|---|---|---|
| 684,531 | 10/1901 | Van Houweling | 198/122 X |
| 742,116 | 10/1903 | Heineke | 198/122 X |
| 1,510,479 | 10/1924 | Hoven | 198/122 X |
| 2,609,115 | 9/1952 | Oklejas | 214/83.34 X |
| 2,768,794 | 10/1956 | Putnam | 404/90 X |

FOREIGN PATENT DOCUMENTS

| | | | |
|---|---|---|---|
| 712,477 | 7/1954 | United Kingdom | 404/90 |

*Primary Examiner*—Nile C. Byers
*Attorney, Agent, or Firm*—Steinberg & Blake

[57] ABSTRACT

The invention relates to a machine for cutting away or peeling off road surfaces including a conveyor machinery transporting the cut away or peeled off material from the road level to a transportation means, said conveyor machinery being tiltingly hinged, at one of its ends, around a substantially perpendicular axis and is swingable from a transport position into an operating position in which it can vertically adjustably be locked. The conveyor machinery is secured, at one of its ends, to a support having bushes at its ends which are vertically adjustably arranged on two parallel guide spars, said guide spars constituting, together with two crossbars secured to the ends thereof, a frame which is tiltingly hinged around the axis of one of said guide spars and which is releasably, and if necessary vertically adjustably, connected with the chassis within the range of the other of said guide spars.

16 Claims, 5 Drawing Figures

MACHINE FOR CUTTING AWAY OR PEELING OFF ROAD SURFACES

Figure 1:
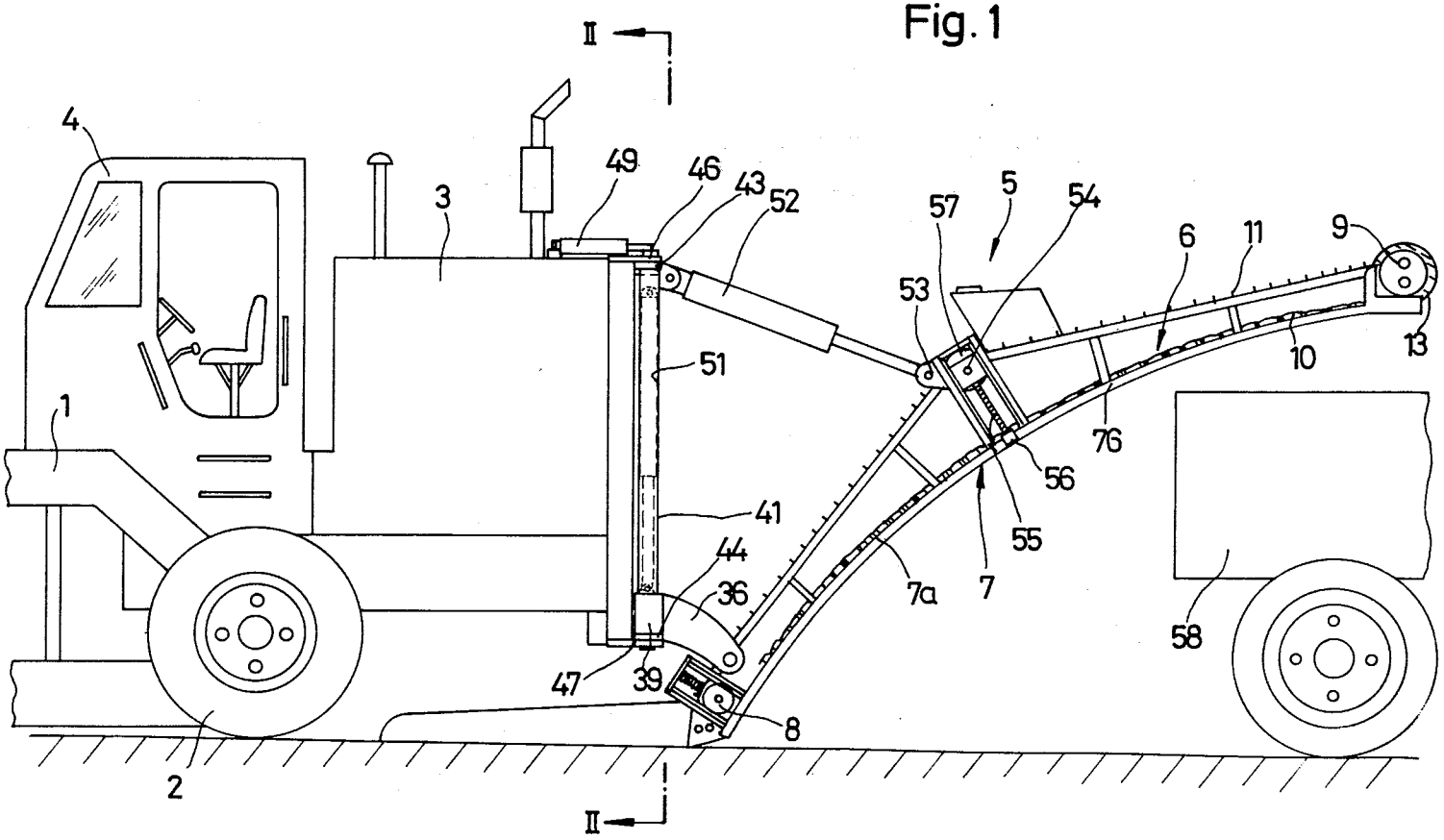

The invention relates to a machine for cutting away or peeling off road surfaces comprising a preferably self-propelled chassis on wheels which includes a cutting or peeling device and a conveyor machinery transporting the cut away or peeled off material from the road level to a level suitable for the transfer into a collecting container, a truck, a trailer, or the like, the conveyor machinery being tiltingly hinged, at one of its ends, to the chassis around a perpendicular, or almost perpendicular, axis and is lockably as well as vertically adjustably pivoted both in an operating position, in which the other of its ends extends backwards beyond the place defined by the chassis and the wheels, and in a rest position, in which the conveyor machinery resides substantially within the space defined by the chassis, the wheels, and the other structural parts.

In a prior construction the conveyor machinery is secured to a first hydraulic operating cylinder and is in releasable connection with a second hydraulic operating cylinder. In order to swing the conveyor machinery around the longitudinal axis of the first operating cylinder, a hydraulic servo motor has been provided on the shaft of which an oblong spur wheel is secured engaging with a spur wheel on the movable portion of the first operating cylinder.

Such an arrangement of the conveyor machinery permits that in pure travelling operation, that is when the machine is moved between the home location and the operating location, the conveyor machinery can be swung away into a position which is not disturbing the traffic while it can be swung, during conveying operation, into a position in which a transfer of the cut away material to a removing vehicle is possible without any difficulties. By the vertical adjustment of the conveyor machinery at its end facing the two operating cylinders, it can furthermore be adapted, in a simple way, to different charging planes. The adjustment of the discharge end of the conveyor machinery to different material transfer levels can, furtheron, be improved in that the conveyor machinery is tiltingly arranged around an axis transversal to the conveying direction.

After the production of a number of machines and the use thereof in practice, it has shown that the machine including the conveyor machinery as described above should be improved, albeit only little, with a view of the production costs as well as to the handling thereof. The swivelling device for instance including hydraulic servo motor and spur wheels is rather elaborate and costly. The same is true for the two operating cylinders serving the vertical adjustment of the conveyor machinery as well as for the extremely precise control device necessary therefor. For optimally loading the truck which removes the cut away or peeled off material, additional personnel is necessary equally distributing on the loading space the material transported onto the truck. This is particularly the case when trucks are used having a high loading plane, which cannot be moved far enough under the discharge end of the conveyor machinery. As a consequence, the material to be removed is assembling in the rear of the loading plane and must be shoveled, by a person, into the front portion of the loading plane.

It is an object of the invention to improve the machine described as concerns the conveyor machinery with a view to a decrease of the production costs as well as with a view to the handling thereof.

This aim is solved, in accordance with the invention, in that the conveyor machinery is secured at one of its ends to a support having bushes at its two ends which are adjustably arranged on two guide spars, and the two guide spars, together with two crossbars secured to the ends thereof, constitute a frame which is tiltingly hinged around an axis of one of the guide spars on the chassis and which is releasably connected with the chassis within the range of the other of the two guide spars.

In using such a structure of the conveyor machinery and by employing suitable measures, not only one of the two operating drives, which would be necessary for the vertical adjustment of the above conveyor machinery, but also the expensive and complicated control device for these operating drives can be spared. The drive system serving to swivel the conveyor machinery can moreover be manufactured in a substantially simpler way. A particular advantage of the structure of the present invention can moreover be seen in that it is substantially more robust and less susceptible to trouble.

For the vertical adjustment of the conveyor machinery, it is advisable to provide, in the middle between the two guide spars, a hydraulic operating cylinder which is secured to the upper crossbar, on one hand, and to the support, on the other. Vertical adjustment drives other than the one described such as a motor-driven tow or a rack-and-pinion or a worm drive can be used as well; the latter drives however are less suitable for the present purpose as they do not permit a vibration-free vertical adjustment or are substantially more expensive.

In a preferred embodiment, a hydraulic operating cylinder for swiveling the frame has been provided which is pivoted, on one hand, to one of the two crossbars at a point remote from the rotating axis of the frame and, on the other hand, to the chassis. Such an embodiment has the advantage over other possible drive structures that it is particularly simple and not susceptible to trouble. To guarantee a troubleproof operation of the operating cylinder for an extended length of time, it is advisable to pivot it to the upper crossbar. This will safely avoid that the operating cylinder is damaged by material falling from the conveyor belt or is impaired in its functioning.

To adapt the conveyor machinery to the different lading planes of the trucks which remove the material, there are secured to the support two bearing frames spaced and symmetrical relative to the middle of the support, to which the conveyor machinery is tiltingly hinged around an axis transversal to the conveying direction. Swivelling of the conveyor machinery around the axis transversal to the conveying direction can either be made by manually operated means or, which would make the handling substantially easier, by a hydraulic operating cylinder which engages, on one hand, with one of the two crossbars and, on the other hand, with one of the crossarms of the conveyor machinery.

In order to guarantee optimum loading of the trucks removing the cut away or peeled off material without needing the personnel for manually reshovelling the material transported onto the truck, the skeleton carrying the conveyor belt of the conveyor machinery is subdivided, in accordance with a further object of the invention, into two portions which are tiltingly connected to each other around an axis neighboring the proceeding conveyor belt. By swivelling the portion pivoted to the frame and by additionally swivelling the portion pivoted to this portion, the conveyor machinery can, in this way, be so adjusted without any difficulties that the truck receiving the material transported from the road level can be moved, with its loading plane, very near to the portion of the conveyor machinery pivoted to the chassis and the discharge end of the other portion of the conveyor machinery can extend far onto the loading plane of the truck. A conveyor machinery so divided has moreover the advantage that in case of pure travel operation, that is when the machine is moved between the home and the place of operation or between its places of operation, the discharge end can be moved into a position in which it is no longer in the vision of the driver. This has the consequence that the traffic safety of the machine is considerably enhanced.

In a preferred embodiment, there is provided in order to swivel one of the skeleton portions relative to the other a screwed spindle and a screwed bushing, one being pivoted to one skeleton portion and the other to the other skeleton portion. It has shown to be of advantage to secure the screwed spindle on the upper part of the one skeleton portion and the screwed bushing to the bottom part of the other skeleton portion. In this way it is safeguarded that the material falling from the conveyor belt will not remain on the screwed spindle and, when operating the spindle, will get between the latter and the screwed bushing which would lead, in time, to a destruction of the screwed spindle and/or the screwed bushing. For an easier handling of the skeleton portion adjustment device it is advisable to drive the means which swivel the two skeleton portions against each other by a motor, independently from the structure of the device selected.

As the width of the transport vehicles which receive the cut away material is rather substantial, the transport truck has, during the cutting process and the simultaneous loading of the cut away material to constantly change its position relative to the conveyor machinery in order to obtain a most uniform distribution on the transport vehicle.

It has shown however that such a measure is extremely difficult to perform in practice.

In accordance with a further particularly advantageous embodiment of the present invention, this problem is also solved in a simple way in that the conveyor machinery described above is releasably connected, in the operating position, via a length-adjustable connecting member, with the chassis.

By a length adjustment of this connecting member, the conveyor machinery can easily be swivelled, during the conveying operation, relative to the longitudinal axis of the machine for cutting away or peeling off road surfaces so that the loading plane of the transport vehicle is covered over its total width by the discharge end of the conveyor machinery.

While the length adjusting connecting member can be provided at any location between the chassis and the lockable portion of the conveyor machinery, it has shown to be particularly advantageous if the frame comprising the two guide spars and the two crossbars is releasably connected, in the operating position, via a length adjustable connecting member, with the chassis. The connecting member can suitably be secured to the tiltable guide spar and any fastening means can be used.

It is shown to be of particular advantage if a hydraulic operating cylinder is provided as the length adjusting connecting member. Such a hydraulic operating cylinder can be remote-controlled from the driver's seat so that no additional personnel are necessary in order to so swivel the conveyor machinery so that the material loaded on the vehicle is uniformly distribution over the whole loading space of the vehicle.

Instead of the hydraulic operating cylinders, a screwed spindle or a so-called rack jack can be used which, if needed, are operated by an operator.

It has proved to be particularly useful if the length adjustable connecting member is tiltingly secured to the chassis and can be connected, via a bolt, with the conveyor machinery or the frame, respectively.

After swivelling the conveyor machinery from the transport position into the operating position, safe locking of the conveyor machinery to the length adjustable connecting member can be obtained with the aid of such a bolt which is course can easily be released when cutting operations have been finished.

The releasing process can be supported by a short actuation of the length adjustment of the connecting member.

The invention will now be described in more detail in connection with the attached drawings in which exemplified embodiments of the invention, in a partly schematic representation, are shown.

Figure 2:
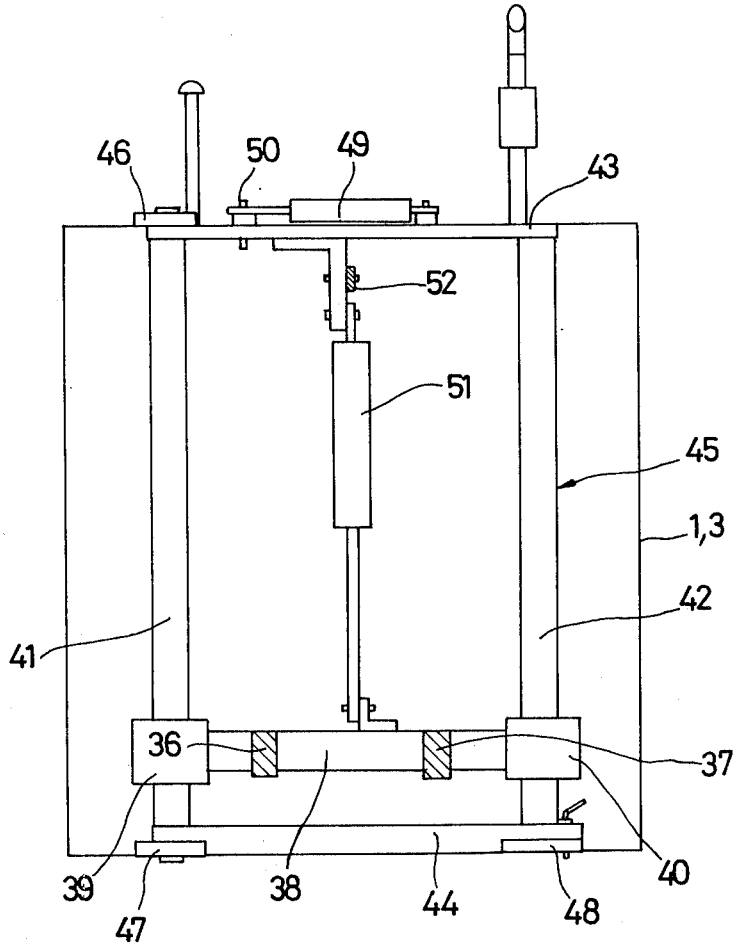
Figure 3:
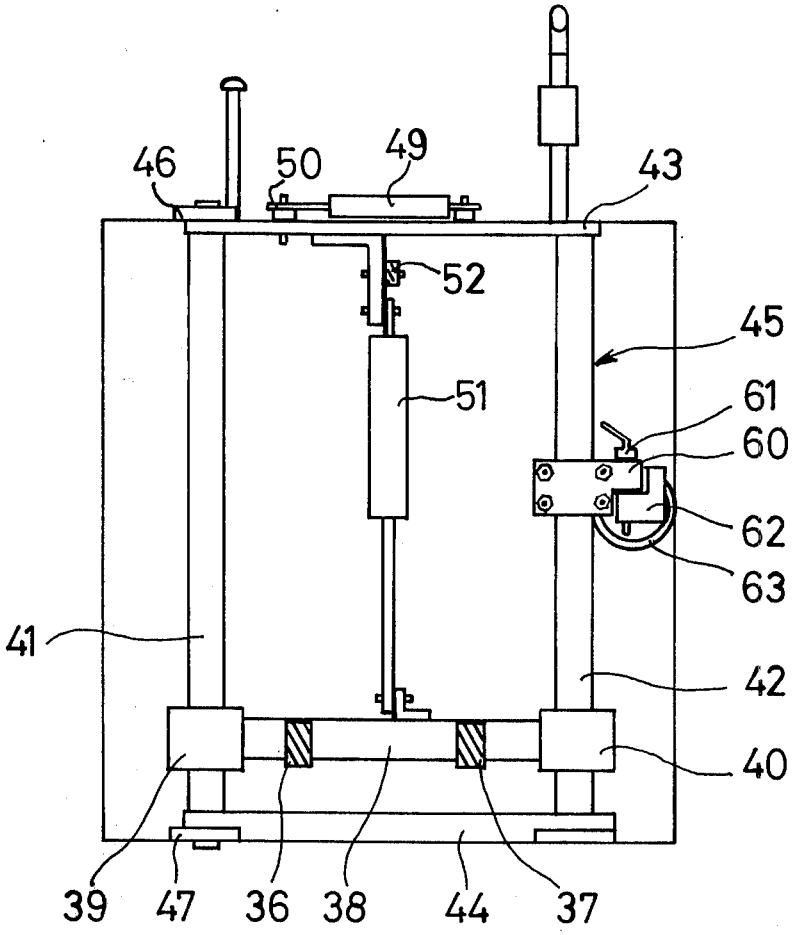
Figure 4:
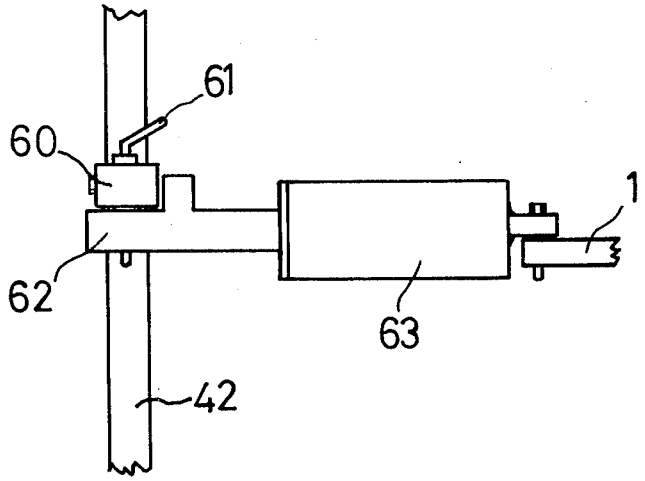
Figure 5:
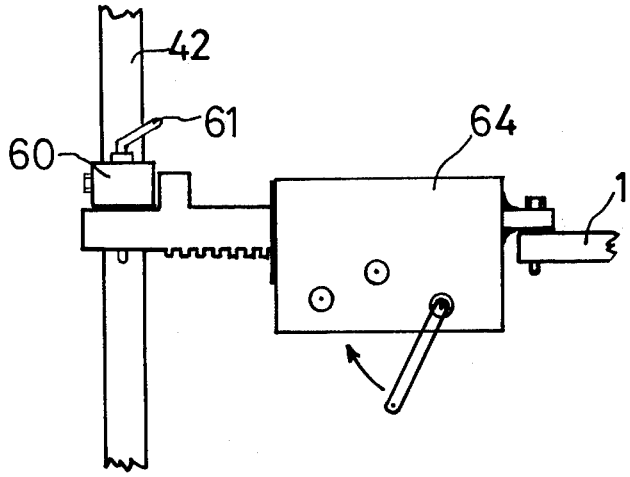

FIG. 1 is a side view of the rear portion of a machine for cutting away rod surfaces, FIG. 2 is a transverse view of a section of the machine according to FIG. 1 along line II—II of FIG. 1, FIG. 3 is a transverse view of the section of another machine according to FIG. 1 along line II—II of FIG. 1, FIG. 4 is a detailed representation of a length adjusting connecting member comprising a hydraulic operating cylinder, FIG. 5 is a detailed representation of a length adjusting connecting member comprising a rack jack.

The machine comprises a chassis 1 having a steerable front wheel pair and two rear wheels 2 and a diesel engine 3 provided in the rear chassis portion, which drives rear wheels 2, and via a gear, the cutter device arranged in the middle of the machine. In front of diesel engine 3, there is the driver's cabin 4 with the control elements for the various aggregates arranged on the chassis.

At the rear end of chassis 1, there is provided conveyor machinery 5. Conveyor machinery 5 is formed as a belt conveyor 6 which consists of a skeleton 7, two deflector rollers 8 and 9 arranged in skeleton 7, an endless belt 10 including cross pieces 11 and a number of non visible backing rolls distributed along the length of skeleton 7. The shaft of the upper deflector roller 9 is coupled to an electromotor 13 by which conveyor belt 10 is driven.

Conveyor machinery 5 is tiltingly supported, at the end neighboring the road level, in two support frames 36 and 37 around an axis transversal to the conveying direction. The two support frames 36 and 37 are secured to a support 38, spaced relative to each other and symmetrical relative to the middle of the support. At the two ends of support 38, there are provided bushings 39 and 40 each which are vertically adjustably supported on two parallel guide spars 41 and 42. Guide spars 41 and 42 form, together with two crossbars 43 and 44 secured to the ends thereof frame 45. Frame 45 is tiltingly secured around the axis of guide spar 41 in two support frames 46 and 47 secured to chassis 1. In the range of guide spar 42, the frame rests, if conveyor machinery 5 is swivelled in the operating position, on a chassis shoulder 48 and is releasably connected therewith.

In order to swivel frame 45, and thus the whole conveyor machinery 5, around the axis of guide spar 41, hydraulic operating cylinder 49 is provided which is pivoted with one of its ends to a point 50 on the upper crossbar 43 remote from the rotating axis of frame 45 while it is pivoted with its other end to chassis 1. A further hydraulic operating cylinder 51 serving for the vertical adjustment of conveyor machinery 5, is arranged in the middle between the two guide spars and is secured to upper crossbar 43, on one hand, and to support 38, on the other. For swivelling the conveyor machinery around the axis transversal to the conveying direction, thereis finally provided a hydraulic operating cylinder 52 which engages with one of its ends to upper crossbar 43 and is pivoted with its other end, to a crossarm 53 of conveyor machinery 5.

As can be seen from FIG. 1, skeleton 7 of conveyor machinery 5 is subdivided into two portions *7a* and *7b*. The two skeleton portions *7a* and *7b* are tiltingly connected with one another at the ends facing each other around common axis 54 while the bottom sides are separated. In order to swivel skeleton portion *7b* relative to skeleton portion *7a*, there is provided a screwed spindle 55 supported at one of its ends at the upper side of skeleton portion *7a* and runs, with its other end, in a screwed bushing 56. Screwed bushing 56 is tiltingly hinged to the bottom side of skeleton portion *7b* around an axis transversal to the longitudinal axis of screwed spindle 55. To the end of screwed spindle 55 neighboring the upper side of skeleton portion *7a*, drive motor 57 is connected. As it is possible to swivel skeleton portion *7b* relative to skeleton portion *7a*, and skeleton portion *7a* relative to chassis 1, it is possible to position the discharge end of conveyor machinery 5 relative to the loading plane of truck 58 to permit optimal loading of the truck removing the cut away or peeled off material.

In the embodiment shown in FIG. 3, fastening means 60 are provided on guide spar 42 by which the guide spar is fastened, via a bolt 61, to a length adjustable connecting member 62. This length adjustable connecting member is provided, in this case, as a hydraulic operating cylinder 63 which is shown in detail in FIG. 4. This hydraulic operating cylinder 63 is tilitingly secured to chassis 1 and makes possible, in the operation position of the conveyor machinery, a swivelling of the discharge end over the total width of the loading plane of transport vehicle 58. In FIG. 5 there is also shown in detail a further length adjustable connecting member comprising a rack jack 64. This length adjustable connecting member, too, is tiltingly secured to chassis 1, on one hand, and via bolt 61, to guide spar 42, on the other.

I claim:

1. A machine for cutting away or peeling off road surfaces comprising a preferably self-propelled chassis on wheels which includes a cutting or peeling device and a conveyor machinery for transporting the cut away or peeled off material from the road level to a level suitable for the transfer into a collecting container, a truck, a trailer, or the like, said conveyor machinery being tilingly hinged, at one of its ends, to said chassis around a substantially perpendicular axis and lockably as well as vertically adjustably pivoted both in an operating position, in which the other of its ends extends backward beyond a plane defined by said chassis and said wheels, and in a rest position, in which said conveyor machinery resides substantially within a space defined by said chassis, said wheels, and other structural parts, wherein said conveyor machinery is secured at one of its ends to a support having bushes at its two ends which are vertically adjustably arranged on two guide spars and said two guide spars together with two crossbars secured to the ends thereof constituting a frame which is hinged for swivelling around the axis of one of said guide spars on said chassis and which is releasably connected with said chassis within the range of the other of said guide spars.

2. A machine according to claim 1 wherein in order to swivel said frame, a hydraulic operating cylinder is provided which is pivoted to a point remote from the guide spar axis of said frame on one of said two cross bars, on one hand, and on said chassis on the other.

3. A machine according to claim 2, wherein said hydraulic operating cylinder is pivoted to the upper crossbar.

4. A machine according to claim 1, wherein in order to vertically adjust said conveyor machinery, in the middle between said two guide spars a hydraulic operating cylinder is provided which is secured to said upper crossbar of the frame, on one hand, and to the support, on the other.

5. A machine according to claim 1 wherein on said support two support frames spaced relative to each other and symmetrical relative to the middle of the support are provided to which said conveyor machinery is tiltingly hinged around an axis transversal to the conveying direction.

6. A machine according to claim 5 wherein a hydraulic operating cylinder is provided which engages with one of said two crossbars, on a hand, and with one crossarm of said conveyor machinery, on the other.

7. A machine according to claim 1 wherein a skeleton of said a conveyor machinery carrying conveyor belt is subdivided into two portions which are tiltingly connected around an axis neighboring said conveyor belt.

8. A machine according to claim 7 wherein in order to swivel one of said skeleton portions relative to the other of said skeleton portions a screwed spindle and a screwed bushing is provided one of which is pivoted to one of said skeleton portions while the other is pivoted to the other of said skeleton portions.

9. A machine according to claim 8 wherein said screwed spindle is secured to the upper part of one of said skeleton portions and said screwed bushing is secured to the bottom part of the other of said skeleton portions.

10. A machine according to claim 7 wherein a means tilting said two skeleton portions relative to each other is driven by a motor.

11. A machine according to claim 1 wherein said conveyor machinery is releasably connected, in the operating position, via a length adjustable connecting member, with said chassis.

12. A machine according to claim 1 wherein the frame comprising said two guide spars and said crossbars is releasably connected, in the operation position, via a length adjustable connecting member, with said chassis.

13. A machine according to claim 11 wherein said length adjustable connecting member is a hydraulic operatng cylinder.

14. A machine according to claim 11 wherein said length adjustable connecting member is a screwed spindle.

15. A machine according to claim 11 wherein said length adjustable connecting member is a rack jack.

16. A machine according to one of claim 11 wherein said length adjustable connecting member is tiltingly secured to said chassis and is connectable via a bolt with said conveyor machinery.

* * * * *